US007386249B2

(12) United States Patent
Bethel et al.

(10) Patent No.: US 7,386,249 B2
(45) Date of Patent: Jun. 10, 2008

(54) ROLLER WITH MECHANICAL PROPERTIES INFLUENCED BY ROTATION

(75) Inventors: Reginald Keith Bethel, Lexington, KY (US); Jarrett Clark Gayne, Lexington, KY (US); James Christopher Piotrowski, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 146 days.

(21) Appl. No.: 11/146,689

(22) Filed: Jun. 7, 2005

(65) Prior Publication Data

US 2006/0275049 A1 Dec. 7, 2006

(51) Int. Cl.
*G03G 15/08* (2006.01)

(52) U.S. Cl. ..... 399/105

(58) Field of Classification Search ..... 399/103, 399/105; 492/39, 49
See application file for complete search history.

(56) References Cited

U.S. PATENT DOCUMENTS

| | | | | |
|---|---|---|---|---|
| 3,685,485 | A * | 8/1972 | Kutsuwada et al. | 399/93 |
| 3,985,436 | A * | 10/1976 | Tanaka et al. | 399/111 |
| 5,331,378 | A | 7/1994 | Baker et al. | |
| 5,465,323 | A * | 11/1995 | Mallet | 345/423 |
| 5,612,769 | A * | 3/1997 | Sugihara et al. | 399/119 |
| 5,702,812 | A | 12/1997 | Bracken et al. | |
| 5,768,662 | A * | 6/1998 | Sugihara et al. | 399/119 |
| 5,874,172 | A | 2/1999 | Beach et al. | |
| 6,487,383 | B2 | 11/2002 | Buchanan et al. | |
| 6,769,679 | B2 * | 8/2004 | Ishibashi | 271/109 |
| 6,962,333 | B2 * | 11/2005 | Mizuno et al. | 271/109 |
| 6,980,752 | B2 * | 12/2005 | Kamimura | 399/103 |
| 7,082,276 | B2 * | 7/2006 | Karakama et al. | 399/111 |
| 2002/0169059 | A1 * | 11/2002 | Couillard | 492/49 |

* cited by examiner

*Primary Examiner*—David M. Gray
*Assistant Examiner*—David A Blackshire
(74) *Attorney, Agent, or Firm*—Grossman, Tucker, Perreault & Pfleger, PLLC

(57) ABSTRACT

A roller capable for use as a developer roller in a printer including a roll body having a surface, wherein the roller provides a first surface flexibility ($SF_1$) when the roller rotates in one direction and a second surface flexibility ($SF_2$) when said roller rotates in a second direction.

20 Claims, 4 Drawing Sheets

ROLLER WITH MECHANICAL PROPERTIES INFLUENCED BY ROTATION

TECHNICAL FIELD

The present invention relates to an image forming apparatus, and more particularly, to a roller with mechanical properties such as surface stiffness that may be influenced by rotation.

BACKGROUND INFORMATION

Image forming devices including copiers, laser printers, facsimile machines, and the like, may include a photoconductive drum having a rigid cylindrical surface that is coated along a defined length of its outer surface. The surface of the photoconductor may be charged to a uniform electrical potential and then selectively exposed to light in a pattern corresponding to an original image. Those areas of the photoconductive surface exposed to light may be discharged, thus forming a latent electrostatic image on the photoconductive surface. A developer material, such as toner, having an electrical charge such that the toner is attracted to the photoconductive surface may be used for forming the image. The toner may be stored in a reservoir or sump adjacent to the photoconductor and may be transferred to the photoconductor by a developer roll. The thickness of the toner layer on the developer roller may controlled by a nip, which is formed between a doctor blade and the developer roller.

A recording sheet, such as a blank sheet of paper, may then be brought into contact with the photoconductive surface and the toner thereon may transferred to the recording sheet in the form of the latent electrostatic image. The recording sheet may then be heated thereby fusing the toner to the sheet.

SUMMARY

In a first exemplary embodiment the present invention is directed at a roller capable for use as a developer roller in a printer comprising a roller having a surface, wherein the roller provides a first surface flexibility ($SF_1$) when the roller rotates in one direction and a second surface flexibility ($SF_2$) when the roller rotates in a second direction, wherein $SF_1$ and $SF_2$ have different values.

In a second exemplary embodiment the present invention is directed at a cartridge for use in an image forming apparatus, the cartridge comprising a frame member and a roller rotatably mounted on the frame member, the roller having a first surface flexibility ($SF_1$) when the roller rotates in one direction and a second surface flexibility ($SF_2$) when the roller rotates in a second direction. The cartridge may also include at least one sealing member mounted to the frame member where the sealing member may contact the roller.

In a third exemplary embodiment the present invention is directed at an image forming apparatus comprising a frame member and a roller rotatably mounted on the frame member, the roller having a first surface flexibility ($SF_1$) when the roller rotates in one direction and a second surface flexibility ($SF_2$) when the roller rotates in a second direction. The image forming device may also include at least one sealing member mounted to the frame member where the sealing member may contact the roller.

BRIEF DESCRIPTION OF THE DRAWINGS

These and other features and advantages of the present invention will be better understood by reading the following detailed description, taken together with the drawings wherein.

DETAILED DESCRIPTION

Figure 1:
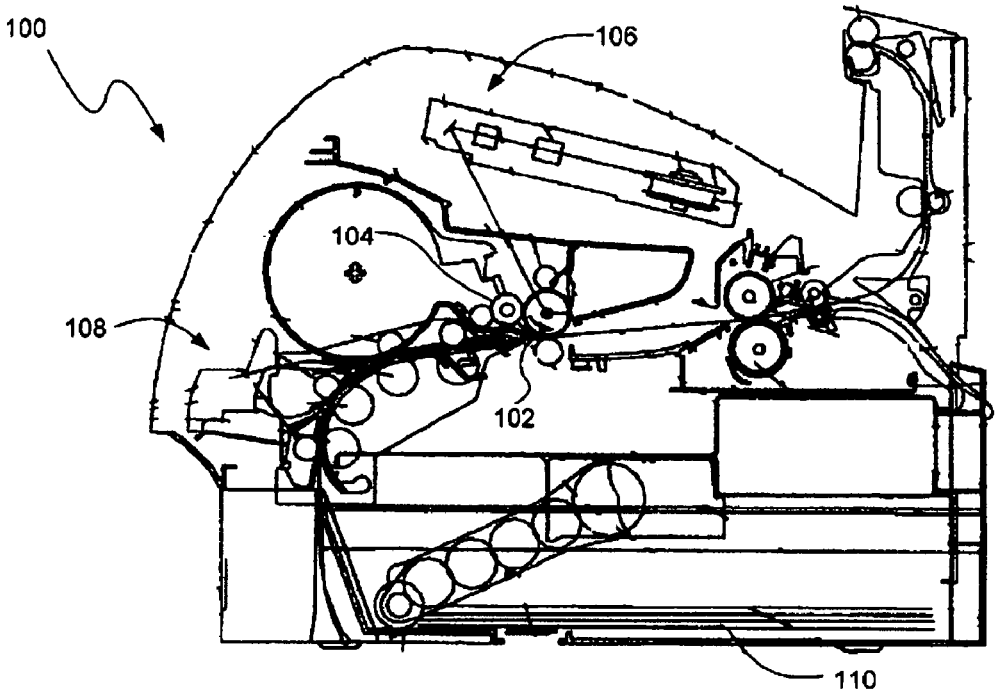
FIG. 1 is a cross-sectional view of an exemplary image forming apparatus.

One example of an image forming apparatus 100 is shown in FIG. 1. The image forming apparatus 100 may include a photoconductive member, such as a PC drum 102, on which the image is formed and a developer roll 104 to transfer toner to the PC drum 102. The toner may be applied to the developer roll 104 and held by electrostatic attraction. The developer roll 104 may rotate in contact with the rotating PC drum 102 to transfer toner to the PC drum 102. The image forming apparatus 100 may also include an optical device 106 that projects the image to be formed onto the PC drum 102 and a transfer mechanism 108 that transfers a recording medium 110 (e.g., paper) to the PC drum 102.

Figure 2:
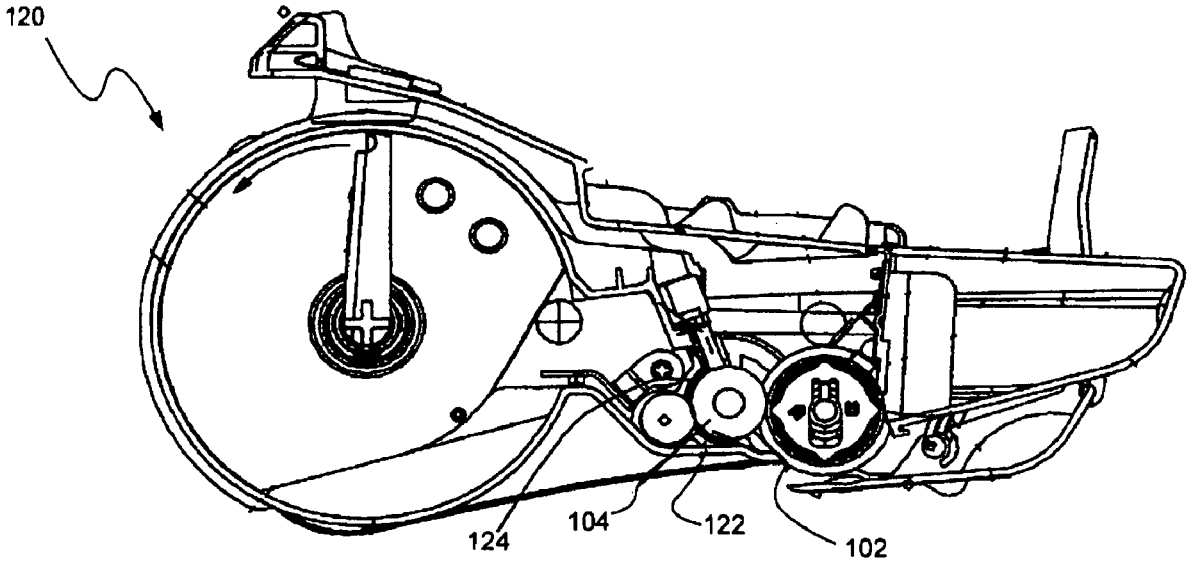
FIG. 2 is a cross-sectional view of an exemplary process cartridge that may be used in an exemplary image forming apparatus.

In one example, the PC drum 102 and/or developer roll 104 may be provided in a process cartridge 120 (e.g., a toner cartridge), as shown in FIG. 2. The process cartridge 120 may be removably mounted within the image forming apparatus 100. The PC drum 102 and developer roll 104 may be rotatably mounted to a frame 122 of the cartridge 120 such that the PC drum 102 and developer roll 104 rotate in contact with each other.

The source of toner may be located on the side of the developer roll 104 opposite the PC drum 102. One or more sealing members 124 may be used at each end of the developer roll 104 to prevent toner from escaping from the ends of the developer roll 104. The sealing member(s) 124 may be shaped to fit the contour of the developer roll 104 and may be resilient such that the seal is firmly pressed against the end of the developer roll 104. One type of sealing member is generally J shaped and may be referred to as a J-seal. One example of a sealing member is described in greater detail in U.S. Pat. No. 6,487,383, which is assigned to the assignee of the present invention and fully incorporated herein by reference.

The friction of the developer roll 104 moving against the sealing member(s) 124 as the developer roll 104 rotates may cause heating in the sealing region, particularly in high speed printers. Heating in the sealing region may cause the toner to melt and may cause the sealing member(s) 124 to fail.

Figure 3:
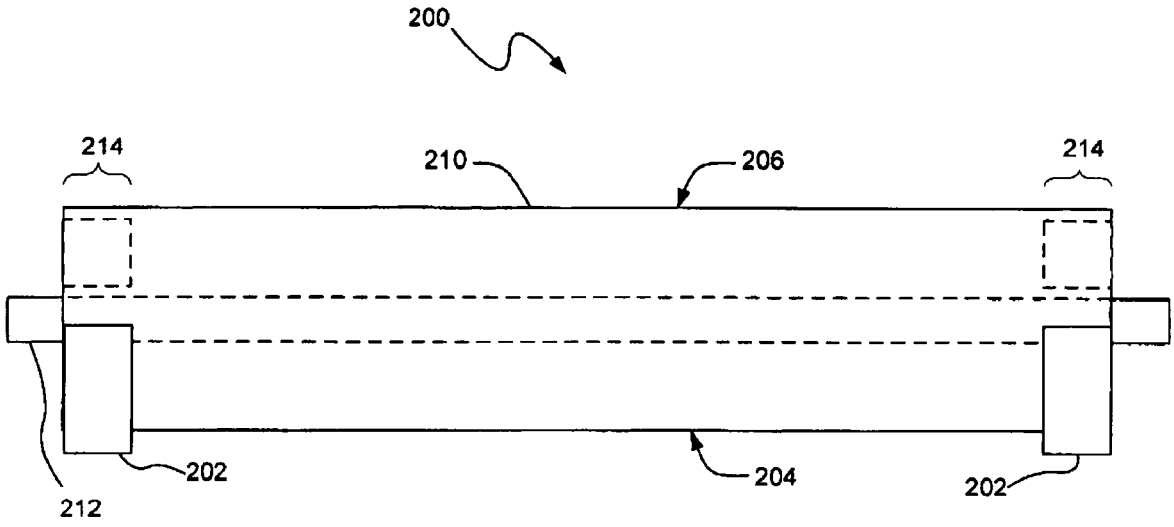
FIG. 3 is a plan view of one embodiment of a developer roll in contact with sealing members.

Referring to FIG. 3, a roll 200, consistent with one embodiment of the present invention, has one or more regions or portions with mechanical property such as surface stiffness or flexibility that may be dependent upon a direction of rotation. Surface stiffness or flexibiilty therefore generally refers to the tendency of the roll 200 to resist inward pressure at any selected location on the roller surface.

In an exemplary embodiment, the roll 200 may be a developer roll used in an image forming apparatus (e.g., a laser printer) such as the type shown in FIG. 1 and/or may be located in a toner cartridge such as the type shown in FIG. 2. When used as a developer roll to apply toner, the roll 200 may receive the toner on one side 204 of the roll 200 and the other side 206 of the roll 200 may rotate in contact with a photoconductive member such as a PC drum 102 (shown in FIGS. 1 and 2). The roll 200 may be rotatably mounted in contact with one or more sealing members 202, such as a J-seal, to prevent toner from escaping from the ends of the developer roll 104. Those skilled in the art will recognize that the roll 200, consistent with embodiments of the present invention, may be used in other applications.

One embodiment of the roll 200 may include a roll body 210 mounted on at least one shaft 212 in a manner known to those skilled in the art. The shaft 212 may extend through the roll body 210 and may be used to rotate the roll body 210 in the image forming apparatus. Although a roll body 210 is shown directly mounted on the shaft 212, other structures or materials may be located between the roll body 210 and the shaft 212. A roll 200 may also be formed without a shaft and may be rotated in other ways known to those skilled in the art. One embodiment of the roll 200 may have a length in a range of about 200-300 mm and an outside diameter in a range of about 10-50 mm.

The roll body 210 may include one or more rotation-dependent stiffness portions 214, which therefore provides a surface that may be compliant or may resist flexing depending upon a direction of rotation. Accordingly, the rotation dependent stiffness portion may provide a first surface flexibility ($SF_1$) when said roller rotates in one direction, and a second surface flexibility ($SF_2$) when said roller rotates in a second direction. The surface flexibility may therefore be understood to correspond to a resistance of the surface to an applied force, such as a frictional force, when engaged with another surface and when rotating. Such surface flexibility may also be evaluated by a consideration of the torque requirements on the roll body, rotated in either a clockwise and counterclockwise direction and when engaged with a given surface.

The rotation-dependent stiffness portion(s) 214 may extend through any part of the roll 200 in which it is desirable to have surface stiffness dependent upon a direction of rotation. In an exemplary embodiment, the roll 200 includes rotation-dependent stiffness portions 214 at each end of the roll 200. The rotation-dependent stiffness portions 214 may extend from the end of the roll 200 to a distance that may be at least equal to the depth of the sealing members 202. For example, each of the rotation-dependent stiffness portions 214 may extend a distance of about 10 mm from the ends of the roll 200. Alternatively, the roll 200 may include a rotation-dependent stiffness portion 214 extending the entire length of the roll 200.

Figure 4:
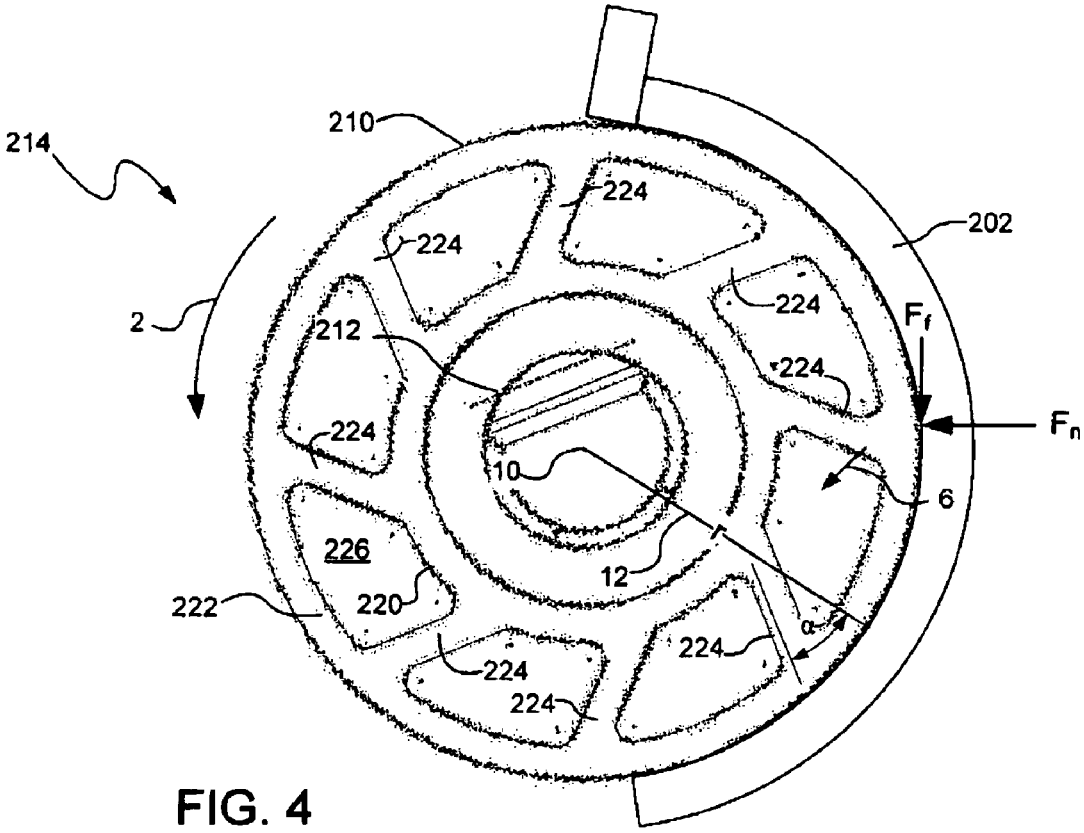
FIG. 4 is a side view of one embodiment of a developer roll rotating in a first direction in contact with a sealing member.
Figure 5:
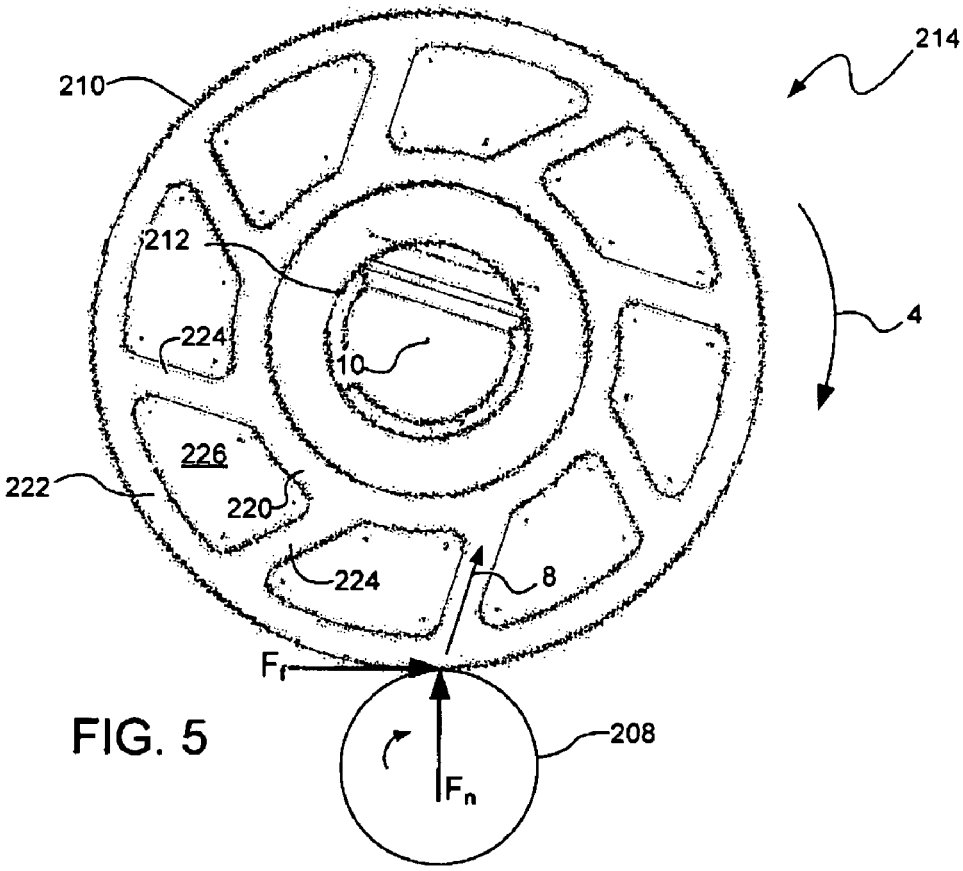
FIG. 5 is a side view of the developer roll shown in FIG. 4 rotating in a second direction in contact with a grinding tool.

A cross-section of a rotation-dependent stiffness portion 214, according to one embodiment, is shown in greater detail in FIGS. 4 and 5. The surface stiffness associated with the rotation-dependent stiffness portion(s) 214 may be lower when the roll body 210 rotates in a first direction, as indicated by arrow 2 (FIG. 4), than when the roll body 210 rotates in a second direction, as indicated by arrow 4 (FIG. 5). In other words, the rotation-dependent stiffness portion 214 may be compliant when rotating in the first direction, allowing the roll body 210 to flex inwardly, and may be stiff when rotating in the second direction, allowing the roll body 210 to resist flexing inwardly.

As shown in FIG. 4, the roll body 210 may rotate in the first direction (shown by arrow 2) against the sealing member 202 during operation of an image forming apparatus. Thus, the roll body 210 may allow a relatively soft sealing interface to reduce friction when rotating against the sealing member 202. As shown in FIG. 5, the roll body 210 may rotate in the second direction (shown by arrow 4) when grinding the roll using a grinding tool 208 during manufacturing. The roll body 210 may allow a higher pressure to be applied to the roll body 210 when rotating against the grinding tool 208 which may enable consistent grinding and to prevent flare.

In one embodiment of the rotation-dependent stiffness portion(s) 214, the roll body 210 may include an inner portion 220, an outer portion 222, and ribs 224 extending from the inner portion 220 to the outer portion 222. The thickness dimension of the roll body 210, inner portion 220, outer portion 222 and ribs 224, at any location may be varied to thereby alter the ability of the rotation-dependent stiffness portion(s) 214 to vary the flexibility of the roller surface. Furthermore it is contemplated that different materials may be selected for roll body 210, inner portion 220, outer portion 222 and ribs 224, wherein such materials may have different values in tensile or flexural type testing, as reflected by values such as tensile modulus ($E_t$) or flexural modulus ($E_{flex}$). The ribs 224 may also define cavities 226 between the inner portion 220 and the outer portion 222. The ribs 224 may allow the rotation-dependent stiffness portion(s) 214 to be compliant when rotating in the first direction and to provide more relative stiffening when rotating in the second direction.

When the roll body 210 rotates in either direction against another surface, a friction force $F_f$ and a normal force $F_n$ may be applied to the roll body 210. The ribs 224 may be configured such that the friction force $F_f$ and the normal force $F_n$ cause bending of the ribs 224, as generally shown by arrow 6, when rotating in the first direction (FIG. 4). The ribs may also provide that the friction force $F_f$ and the normal force $F_n$ cause the ribs 224 to be in compression, as shown by arrow 8, when rotating in the second direction (FIG. 5). When in bending, the ribs 224 may allow the rotation-dependent stiffness portion 214 to be relatively more compliant. When in compression, the ribs 224 may stiffen, and allow the rotation-dependent stiffness portion 214 to better resist flexing. The degree of stiffness/flexibility in the rotation-dependent stiffness portions 214 may depend on the thickness of the material in the outer portion 222 and/or the ribs 224.

The rotation-dependent stiffness portion(s) 214, shown in FIGS. 4 and 5, may include angled linear ribs 224. The angled linear ribs 224 may be oriented non-radially with respect to the axis of rotation 10 such that each rib 224 forms an angle $\alpha$ with respect to a radius 12 passing through the rib 224 (see FIG. 4). The angle $\alpha$ may be dependent upon the forces acting on the roll body 210, and in one embodiment, the angle $\alpha$ may be in a range of about 20-90 degrees. In this embodiment, the inner portion 220 may have a thickness in a range of about 0.5-5.0 mm, the outer portion 222 may have a thickness in a range of about 0.5-5.0 mm, and the linear ribs 224 may have a thickness in a range of about 0.5-5.0 mm.

Figure 6:
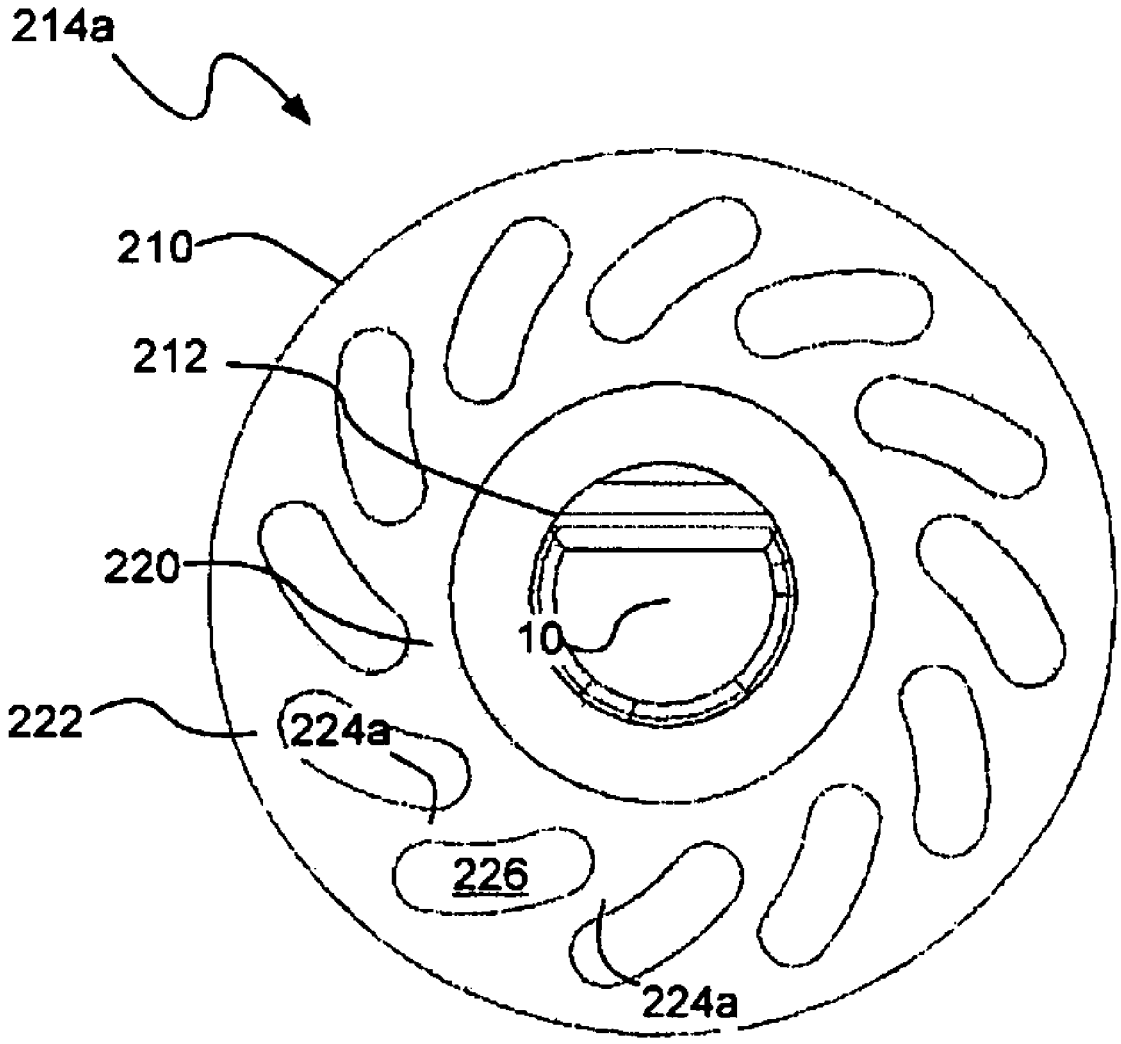
FIG. 6 is a side view of another embodiment of a developer roll.

Another embodiment of the rotation-dependent stiffness portion(s) **214*a*, shown in FIG. 6, may include helical ribs 224*a*. The helical ribs 224*a* may extend helically with respect to the axis of rotation 10. The helical ribs 224*a* may advantageously provide a more uniform deflection of the surface of the roll body 210. In this embodiment, the inner portion 220 may have a thickness in a range of about 0.5-5.0 mm, the outer portion 222 may have a thickness in a range of about 0.5-5.0 mm, and the helical ribs 224*a*** may have a thickness in a range of about 0.5-5.0 mm. Those skilled in the art will recognize that other configurations and orientations for the ribs may also result in rotation-dependent stiffness portions.

According to one embodiment, the roll body 210 may be made of a thermoplastic or thermoset elastomeric type material and an optional surface coating may be applied to the outer surface of the roll body 210. Such surface coating may therefore be a resistive type coating. By elastomeric it should also be understood that the material may have a glass transition temperature (Tg) below room temperature and be primarily amorphous, or in application in, e.g., a printer, the material may substantially recover after an applied stress. For example, the roller made be made by casting a urethane prepolymer mixed with polydiene diol. The urethane prepolymer may include a polcaprolactone ester in combination with an aromatic isocyanate, such as toluene-diisocyanate. The roller may also contain a filler such as ferric chloride and the polydiene diol may include a polyisoprene diol or polybutadiene diol. The urethane developer roller may therefore be prepared by casting such urethane prepolymer mixed with the polydiene diol, along with a curing agent and filler such as ferric chloride powder, in addition to an antioxidant (e.g. a hindered phenol such as 2,2'-methylenebis (4-methyl-6-tertiarybutyl) phenol or 2,6 di-tertiary-4-methyl phenol. After curing the roller may then be baked to oxidize the outer surface, which may then be electrically resistive. In addition, in yet another exemplary embodiment, the roller may be prepared from Hydrin® epichlorohydrin elastomers, available from Zeon Chemicals Incorporated, which may then be coated with a polyurethane type coating.

In one embodiment, the cavities 226 formed between the ribs 224 may include air. Alternatively, the cavities 226 may include a filler material, such as foam, where the filler material may selected to further contribute and influence the rotation-dependent stiffness portions. For example, foam of varying density may be employed.

Accordingly, the roll 200 including rotation-dependent stiffness portions, consistent with embodiments of the present invention, may be capable of reducing friction in the sealing region. The roll 200 may be more compliant when rotating in the first direction against such sealing members. The roll 200 may also be capable of being ground properly because the roll 200 may be stiffer at a selected surface location when rotating in a second direction against a grinding tool.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A roller capable for use as a developer roller in a printer comprising: a roller having a surface, a length and two end portions, wherein said roller provides a first surface flexibility ($SF_1$) when said roller rotates in one direction and a second surface flexibility ($SF_2$) when said roller rotates in a second direction wherein $SF_1$ and $SF_2$ have different values, and wherein said roller includes an inner portion, an outer portion and ribs extending from the inner portion to the outer portion wherein said inner portion, outer portion and ribs independently have a thickness in the range of about 0.5-5.0 mm, wherein said ribs are capable of bending when said roller rotates in one direction and compression when said roller rotates in a second direction and wherein said roller comprises polyepichlorohydrin or a polyurethane and said ribs extend from the two ends of said roller a distance of up to about 10 mm and said roller includes portions without said ribs along the length of said roller.

2. The roller of claim 1 wherein said first surface flexibility and second surface flexibility are provided at selected locations on said roller surface.

3. The roller of claim 1 wherein said roller has a radii and said ribs extend at an angle with respect to said radii.

4. The roller of claim 1 wherein said ribs include helical ribs.

5. The roller of claim 1 further comprising a shaft extending through said roller.

6. The roller of claim 1 wherein said roller defines cavities between said ribs.

7. The roller of claim 1 further comprising a coating on an outer surface of said roller.

8. The roller of claim 1 wherein said roller provides said first surface flexibility ($SF_1$) when said roller rotates in one direction and said second surface flexibility ($SF_2$) when said roller rotates in a second direction at first and second end portions of said roller.

9. The roller of claim 8 wherein said roller is solid between said first and second end portions.

10. A cartridge for use in an image forming apparatus, said cartridge comprising: a frame member; a roller having a length and two end portions and rotatably mounted on said frame member, said roller having a first surface flexibility ($SF_1$) when said roller rotates in one direction and a second surface flexibility ($SF_2$) when said roller rotates in a second direction wherein $SF_1$ and $SF_2$ have different values; and at least one sealing member mounted to said frame member, said sealing member contacting said roller, and wherein said roller includes an inner portion, an outer portion and ribs extending from the inner portion to the outer portion wherein said inner portion, outer portion and ribs independently have a thickness in the range of about 0.5-5.0 mm, wherein said ribs are capable of bending when said roller rotates in one direction and compression when said roller rotates in a second direction and wherein said roller comprises polyepichlorohydrin or a polyurethane and said ribs extend from the two ends of said roller a distance of up to about 10 mm and said roller includes portions without said ribs along the length of said roller.

11. The cartridge of claim 10 wherein said at least one sealing member includes first and second sealing members contacting a first and second portion of said roller.

12. The cartridge of claim 11 wherein said first and second portions of said roller include a first and second end portion of said roller.

13. The roller of claim 12 wherein said roller is solid between said first and second end portions.

14. The cartridge of claim 10 wherein said roller has a radii and said ribs extend at an angle with respect to said radii.

15. The cartridge of claim 10 wherein said ribs include helical ribs.

16. The cartridge of claim 10 further comprising a photoconductive drum rotatably mounted in said frame, wherein said photoconductive drum is in contact with said roller.

17. The cartridge of claim 16 wherein said roller applies a developer material to said photoconductive drum.

18. An image forming apparatus comprising: a frame member; a roller having a length and two end portions rotatably mounted on said frame member, said roller having a first surface flexibility ($SF_1$) when said roller rotates in one direction and a second surface flexibility ($SF_2$) when said roller rotates in a second direction wherein $SF_1$ and $SF_2$ have different values; and at least one sealing member mounted to said frame member, said sealing member contacting said roller, and wherein said roller includes an inner portion, an outer portion and ribs extending from the inner portion to the outer portion wherein said inner portion, outer portion and ribs independently have a thickness in the range of about 0.5-5.0 mm, wherein said ribs are capable of bending when said roller rotates in one direction and compression when said roller rotates in a second direction and wherein said roller comprises polyepichlorohydrin or a polyurethane and said ribs extend from said two ends of said roller a distance of up to about 10 mm and said roller includes portions without said ribs along the length of said roller.

19. The image forming device of claim 18 wherein said at least one sealing member includes first and second sealing members contacting a first and second portion of said roller.

20. The image forming device of claim 18 wherein said first and second portions of said roller comprise a first and second end portion of said roller.

* * * * *